US005921418A

United States Patent [19]

Pugh

[11] Patent Number: 5,921,418

[45] Date of Patent: Jul. 13, 1999

[54] VALVE CAP FOR TWO LITER BOTTLE

[76] Inventor: Gary L. Pugh, 123 S. Pine, Eureka, Kans. 67045

[21] Appl. No.: 08/925,159

[22] Filed: Sep. 8, 1997

[51] Int. Cl.[6] ..... B65D 39/00

[52] U.S. Cl. ..... 215/247; 215/228; 141/64

[58] Field of Search ..... 215/228, 247, 215/311; 220/212, 203.17; 206/205, 216, 315.9; 141/64

[56] References Cited

U.S. PATENT DOCUMENTS 3,233,727 2/1966 Wilson ..... 215/247

4,161,247 7/1979 Feinberg et al. ..... 206/315.9

4,838,324 6/1989 Boyd ..... 141/64

*Primary Examiner*—Stephen K. Cronin

*Attorney, Agent, or Firm*—Bradley P. Sylvester

[57] ABSTRACT

A valve device that is incorporated into the cap used on plastic bottles, which allow the bottles to receive the injection of gaseous pressure so that the walls of the plastic bottles become firm and rigid, which maximizes the bottles floatation potential. This allow the bottles to be handled and stored easily. These bottles have uses for many types of floatation needs, such as buoys, rafts, etc. The bottles are particularly useful as floatation devices in the sport of fishing, with the addition of fishing lines and hooks.

7 Claims, 2 Drawing Sheets

VALVE CAP FOR TWO LITER BOTTLE

BACKGROUND OF THE INVENTION

This invention is an improvement over existing art, involving the use of two liter bottles used as floatation devices in water. Prior art includes the use of ordinary two liter bottles, which are used as floats for fixed set line hook sets. In prior art, a fishing line is fixed to a two liter bottle, which is used as a float. A desired amount of line trails from the float. The trailing line has a hook attached thereto, and is generally weighted near the hook. The other end of the line extends from the float to a fixed location, so that when the line is played out in water, the two liter bottle float will hold the portion of line, having the hook in a stable position as to depth.

A significant drawback to this use of the two liter bottle is the lack of pressure inside the bottle as compared with pressure outside the bottle. This causes the walls of the bottle to be flexible, so that the bottle, even if sealed with a cap, will collapse inward when squeezed or picked up. This causes difficulty in handling the bottle. If the line is wound around the bottle, as it is drawn in, prior bottles will collapse, since there is no higher pressure within the bottle, so that the line is incapable of being wound on the bottle tightly the first time. In addition, the maintaining of pressure within the bottle allows the bottle to be stored with line wrapped around it, and since the bottle maintains its configuration, it will not allow the line to unravel, or slide along the bottle length due to deflation. This allows pressurized bottles to be stored in an unorganized grouping, without tangling of wound lines from bottle to bottle.

SUMMARY OF THE INVENTION

This invention utilizes a valve assembly in the two liter bottle cap, so that gaseous pressure can be applied to the bottle's interior, without removing the cap. The valve assembly comprises a pliable insert portion that is fixed within a hole in the top portion of the cap. The pliable insert portion defines an air passageway, that allows the insertion of an air needle, so that air can be delivered through the air needle into the bottle's interior. When the needle is withdrawn, the pliable insert returns to normal shape, closing off the air passageway, so that any greater air pressure within the bottle does not escape.

The invention contemplates a new and novel valve seated within a bottle cap portion that can be screwed onto a bottle, where the cap has an outer hard plastic shell, with the thermoplastic or rubber insert valve situated within a hole in the cap's hard plastic shell. This valve assembly can be incorporated into modified caps where the existing cap has a hole drilled through it, which allows it to receive a valve portion. The valve portion is able to provide a seal within the hole, and provides a means to receive injected gases into a bottle and allowing pressure to be maintained within said bottle.

The valve portion is comprised of an elastomeric thermoplastic or rubber cylinder which encases a central core of elastic rubber or urethane, where the core has an air passageway defined through its length. The thermoplastic or rubber cylinder encloses the elastic rubber or urethane core, and slightly compresses it so that there is an inward collapsing of the air passageway, which provides an airtight seal as to the flow of air through the air passageway. This particular type of valve portion is well known in the field of prior art. The thermoplastic or rubber cylinder, also referred to as the thermoplastic or rubber holder column, may have a flange protruding outward at the top portion of the thermoplastic or rubber column, with the shape of the flange being generally circular, with the size of the flange allowing it to be placed within a bottle cap, and pressed against the cap's inner flat surface. This flange can assist the valve in providing an airtight seal against the cap's inner surface. Since many bottle caps already have a liner insert, which is compressible, the thermoplastic or rubber column may be used without the flange.

The nipple has a nipple flange protruding outward from the base of the nipple, where it is attached to the thermoplastic or rubber cylinder. The nipple flange allows the nipple and nipple flange to be pushed through a bottle cap hole, with the nipple flange preventing reverse removal of the nipple. The nipple flange and thermoplastic or rubber column each press against the bottle cap, to provide an airtight seal. Air inside the bottle, when under pressure, will also provide additional force that presses the thermoplastic or rubber column against the bottle cap's inner surface. The length of the nipple may be gripped to assist in pulling the nipple and nipple flanges through the cap hole. When pulled, the nipple will elongate, and decrease in circumference, allowing the nipple and nipple flanges to be more easily pulled through the cap hole. Once the nipple is pulled through the cap hole, and seated properly in the cap hole, the nipple length may be removed above the nipple flange.

The valve assembly, when used with a bottle, such as a common two liter bottle used for beverages, allows gas to be pressurized within the bottle, to provide maximum floatation capabilities, and a firm outer surface, to accommodate easy storage and use in fishing activities.

Accordingly, it is the object of this invention to cause a new and novel cap and valve to be used with existing bottles, which allows the bottle to be pressurized using an air needle, which provides a means to allow injection of pressurized gases into the bottle, and the retention of said pressurized gas within the bottle.

It is a further object of this invention to provide a valve assembly and modified bottle cap, so that when combined into a single unit, the modified cap may be used with existing bottles to allow pressure to be delivered into the bottle interior using a common air needle.

It is a further object of this invention to provide a valve assembly and modified bottle cap, where a plastic bottle can be pressurized, so that it provides a rigid surface that can accommodate string or line being tightly woven around the circumference of the bottle, without any appreciable collapsing of the bottle, so that the line or string remains tight around the bottle, and can be stored with other similar pressurized bottles, with minimal intertwining or tangling of the line or string.

It is a further object of this invention to provide a valve assembly and modified bottle cap, that allows a bottle, such as a typical two liter bottle, to be pressurized, which allows a user to grip and handle the bottle easier, and which also maximizes the floating capacity of the bottle, by realizing the bottles maximum volume using pressurized gas.

DESCRIPTION OF THE PREFERRED EMBODIMENT

Figure 1:
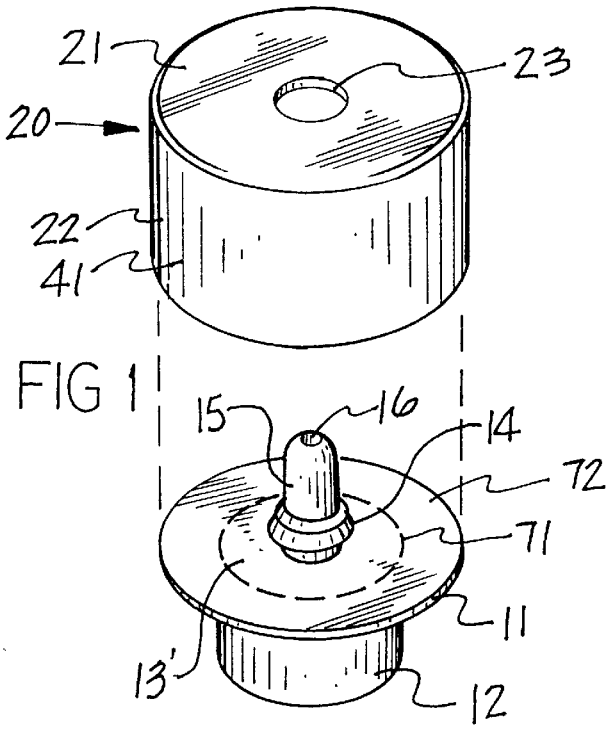
FIG. 1 depicts an exploded perspective view of the bottle cap and valve, in which the valve assembly is shown orientated to a receiving bottle cap.
Figure 2:
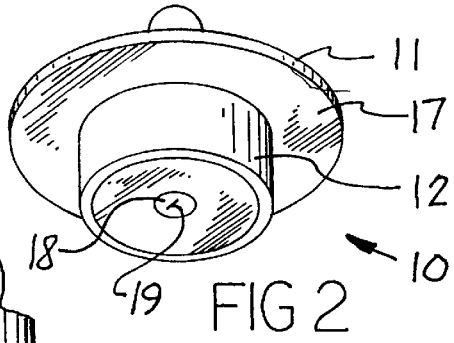
FIG. 2 depicts a perspective view of the bottom side of a valve assembly for use with a bottle cap, where said valve has a peripheral flange.
Figure 6:
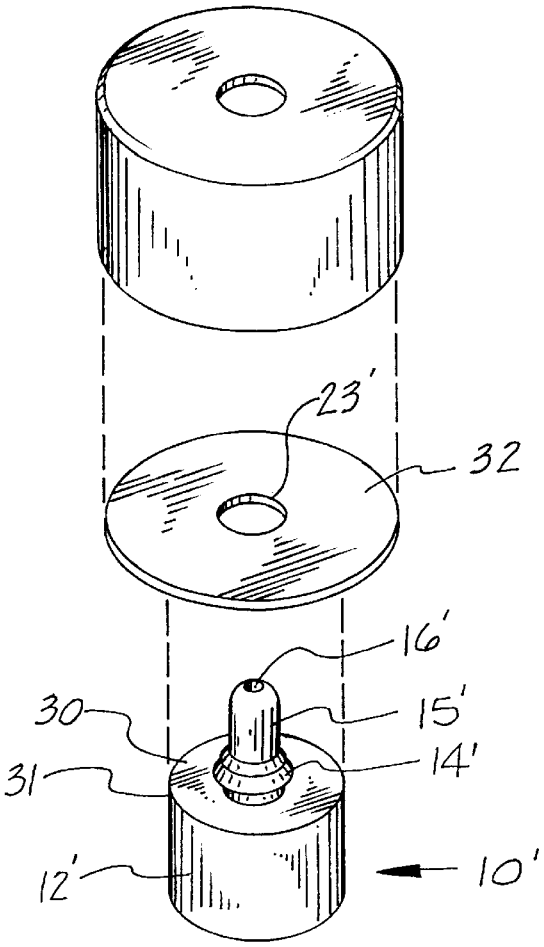
FIG. 6 depicts an exploded perspective view of a bottle cap and valve assembly joined together.

Referring to FIG. 1, a plastic or thermoplastic or rubber insert portion, being a valve assembly 10 is shown, having an thermoplastic or rubber holder column 12, that surrounds a central soft core 18 of elastomeric material such as a soft elastic rubber or ether based urethane.

Where the valve assembly 10 will be joined to a cap 20, as shown in FIG. 1, where the cap 20 does not have an existing cap insert 32, as depicted in FIG. 6, a peripheral flange 72 may extend outward from the thermoplastic or rubber column 12 and is defined by edge 11. The peripheral flange 72 has a top side 13 and a bottom side 17, as shown in FIG. 2. The extension of the peripheral flange 72 is defined by the distance from the edge 71 of the holder column 12 to the flange edge 11.

Protruding outward from the central area of the peripheral flange top side 13 is a nipple 15, which has an elongated shape that terminates in an end having an opening 16 to an air passageway 70. The purpose of the nipple's 15 elongated shape is to allow it to be pulled though the hole 23 in the cap 20. The opening 16 defines a top end of a passageway 70 that extends through the nipple 15 and the holder column 12, with the bottom end 19 of the passageway 70 being centrally located on the bottom side of the holder column 12, as shown in FIG. 2. The passageway 70 is oriented in a fairly straight line between the top opening 16 and the bottom opening 19. The passageway is normally closed or collapsed on itself, due to a constricting or squeezing pressure applied by the thermoplastic or rubber holder column 12. The elastic soft core 18 occupies a greater area than is allowed by the internal space defined by the holder column 12, so that when the elastic soft core 18 is placed into the holder column 12, the walls of said holder column 12 force the soft elastic core 18 to be compressed.

The nipple 15 may have one or more nipple flanges 14 radiating outward from the circumference of the nipple 15. The nipple flanges 14 are situated along the nipple 15 with the space between the nipple flange 14 and the holder column 12 able to accommodate the cap 20 and a cap insert 32, if present. A length of the nipple 15 extends beyond the nipple flanges 14, with the circumference of the nipple being of sufficiently small size so that it can be pulled through the hole 23 in the cap 20. Preferably, the circumference of the nipple 15 will exceed the circumference of the hole 23, with the resilient thermoplastic or rubber consistency of the nipple 15 able to be inserted through the hole 23. Gripping the nipple 15 and pulling it through the cap hole 23 will cause the nipple 15 to elongate and decrease in circumference, with the same effect being applied to the nipple flange 14. This will allow the nipple 15, and nipple flange 14, to be pulled through the cap hole 23, with the nipple 15 and nipple flange 14 expanding to their original circumference when the pulling force is ceased, so that the nipple 15 will fill the cap hole 23, and the nipple flange 14 will have a circumference that does not readily allow retraction or removal back out of or through the cap hole 23.

Referring also to FIG. 2, the bottom side of the valve assembly 10 is shown. A peripheral flange 72 extends radially from a centrally located elastic thermoplastic or rubber holder column 12. The thermoplastic or rubber holder column 12 and soft elastic core 18 are preferably separately formed pieces, with the holder column 12 being of a material that is more sturdy and less elastic than the soft elastic core 18 it surrounds.

Figure 2A:
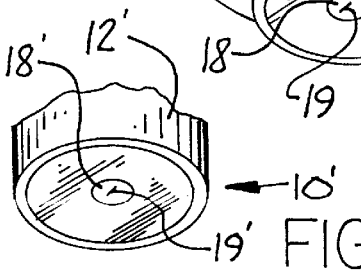
FIG. 2*a* depicts a perspective view of the bottom side view of the valve assembly, in which there is no peripheral flange.
Figure 7:
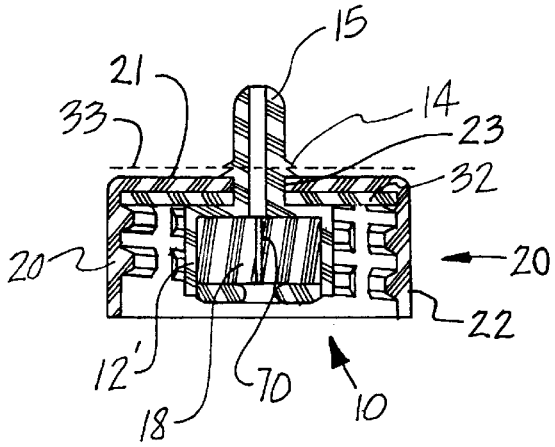
FIG. 7 depicts a cross sectional view of the bottle cap and valve assembly.

The central portion of the valve assembly 10, or 10' in FIGS. 2*a*, 6 and 7, is a soft elastic core 18 which defines a central passageway 70, as shown in FIG. 7. The passageway 70 has a bottom open end 19, with said passageway 70 extending through the soft elastic core 18. And is accessible with a common air needle 40 through the top opening 16.

Figure 4:
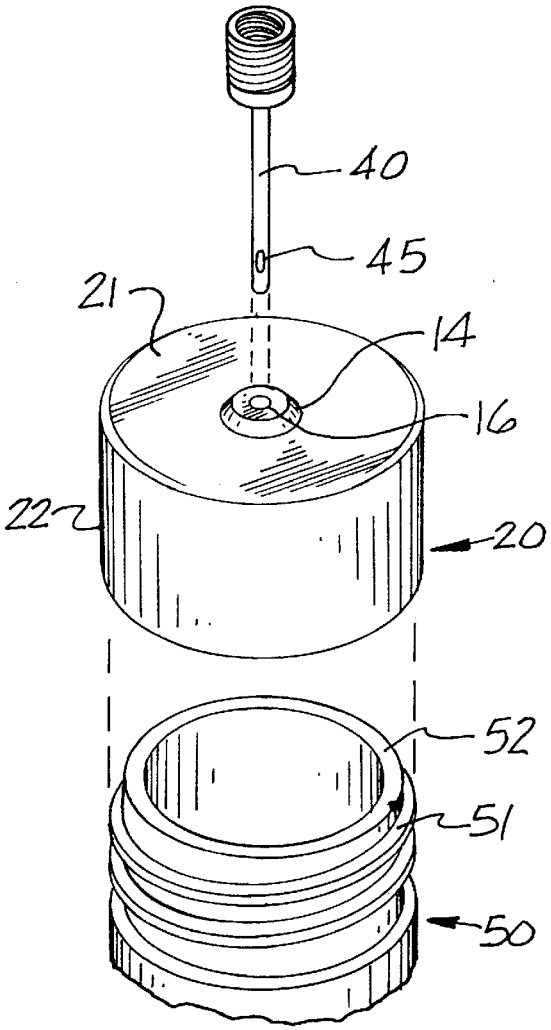
FIG. 4 depicts a perspective view of the bottle cap valve, air needle and bottle neck, when the valve assembly is used to allow the delivery of air pressure to the bottle interior.

Movement of air through the passageway 70 is restricted by the constant collapsing pressure by the column holder 12 against the soft elastic core 18, which constricts the circumference of the passageway 70. Any type of soft elastic material may be used for the core 18, such as ether based urethane, as long as the material is able to be compressed so as to cause the passageway 70 within it to revert to a closed or constricted position, but which also allows an item such as an air needle shaft 40, as shown in FIG. 4, to be inserted through it.

Referring again to FIG. 1, the exterior portion of a cap 20 is shown, in which a cylindrical side wall 22 defines a circular top side 21. The circular top side defines a hole 23, which extends through the top side 21. The circumference of the hole 23 is of sufficient size so that the nipple 15 can be inserted through said hole 23, along with flanges 14. The circumference of hole 23 may be less than the circumference of the nipple 15, as long as the nipple 15 can be pushed or pulled through the hole 23, with the nipple flanges 14 also able to move through the hole 23 until they are able to rest against the top side 21 of cap 20. The elongated shape of the nipple 15 can assist the manufacturing process, by allowing the nipple 15 to be pulled through the hole 23 in the cap 20. The nipple flanges must have a circumference greater than the hole 23, so that they resist being moved or pulled back through the hole 23.

Figure 5:
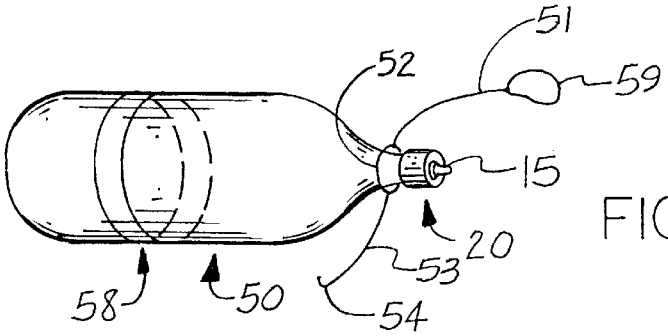
FIG. 5 depicts a perspective view of a bottle having a bottle cap valve on the bottle.

The cap's cylindrical side wall 22 may have a plurality of longitudinal grooves 41 to assist a person's hand in the gripping of said cap 20 for purposes of tightening or loosening said cap 20 on a bottle 50, as shown in FIG. 5. Such grooves are common on many caps used to seal bottles.

Figure 3:
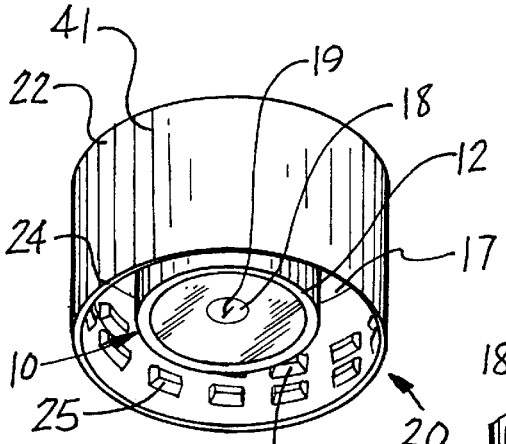
FIG. 3 depicts a perspective view of the valve assembly inserted through a hole in the bottle cap.

Referring also to FIG. 3, the interior of the cap 20 is shown, in which raised notches 26 define a set of screw type ridges. The valve assembly 10 is positioned inside the cap 20, as shown in FIG. 3, with the flange top side 13 pressed against the interior of the cap 20. The raised notches 26 may assist in holding the valve assembly 10 in position, by pressing against the peripheral flange bottom side 17. The elastic thermoplastic or rubber holder column 12 extends downward within the cap 20, so that the passageway bottom opening 19 is exposed within the interior of the cap 20.

Referring to FIG. 2*a*, a valve assembly 10' is shown, in which a single holder column 12' is shown, with a central soft elastic rubber core 18' shown, having a bottom opening 19' for an air passageway 70. The rubber holder 12 defines an opening that allows access to the bottom opening 19'. The top side of the valve assembly 10', is identical to that shown in FIG. 1, with the exception that the flange top side 13 does not extend outward beyond the thermoplastic or rubber holder column 12' itself. The circumference of the edge 31 of the single holder column 12' is shown in FIG. 1, with the edge 31 having a circumference greater than the circumference of the hole 23. Referring also to FIG. 6, the valve assembly 10', is shown without the flange.

Referring to FIG. 6, the valve assembly 10' is shown, in which the holder column does not have flange 72. In FIG. 1, the top edge of the holder column 12 is shown by dashed lines and designated as number 71. This same edge is designated as 31 in FIG. 6. In FIG. 6, the holder column 12' has a top side 30, which has a nipple 15' protruding upwards from the top side 30. The nipple 15' has at least one nipple flange 14' which is shaped with a sloping top side, so that it allows penetration through hole 23, but has a perpendicular underside, which prevents said flange 14' from being easily pulled backward through the hole 23. FIGS. 6 and 7 show a nipple 15' having two flanges 14'. A second flange 14', if present serves as a guide in which a cut is made along line 33, to remove the length of the nipple 15', with the resulting appearance being that as shown in FIG. 4. Both valves 10 and 10' are preferably cut along line 33, so that the end resulting appearance is as shown in FIG. 4.

If the valve assembly 10' lacks the flange 72, the necessary compression of an elastic material by the bottle mouth 52 against the cap 20, is done by previously inserting a cap liner 32, where such liners 32 are common to bottle caps 20. The cap liner 32 should already be pressed against the caps 20 inner flat side. The cap liner 32 must have a hole 23' that allows the nipple 15' to penetrate through it as well as the cap's hole 23. When the valve assembly 10' is positioned properly with the cap 20, the resulting cross sectional view is shown in FIG. 7. FIG. 7 shows that the passageway 70 is orientated in a generally perpendicular position to the top surface of the cap 20, with the cap liner 32 compressed between the column's top side 30 and the cap 20. Use of the valve assembly 10' is accomplished as shown in FIG. 4, in the same manner as that for valve assembly 10, which is described further below.

When using the single holder column 12', the cap 20 preferably has a cap liner 32, as is commonly known and used in the art of manufacturing bottle caps, where the cap liner 32 comprises a flexible plastic sheet that is fixed to the upper interior portion of the cap 20. When the single holder column 12' is placed against the bottom side of the cap liner 20, with the nipple 15 situated properly within holes 23 and 23', a air tight seal will be created at the point where the top of the single holder column 12', the cap liner 32, and the interior surface of the cap 20 contact each other.

If the cap liner 32 is in place, this will assist the single column holder 12' in creating and maintaining a seal, where the cap liner 32 is located between the single column holder 12' and the cap 20. The nipple 15, nipple flanges 14, and opening 16 are all identical as described above. When this valve assembly 10' is placed into a cap 20, as shown in FIG. 6, it is oriented identically as the valve assembly 10 shown in FIG. 3. Since there is no peripheral flange in the valve assembly 10', the raised areas 25 and 26 of cap 20 serve no useful purpose, with regard to this valve assembly 10'.

Referring also to FIG. 4, the joining of the cap 20 and valve assembly 10 or 10' is accomplished by causing the nipple 15 to be pushed through the hole 23, from the bottom to top side of cap 20. When using the valve assembly 10, the nipple 15 is pushed or pulled through the hole 23 until the flange top side 13 is pressed against the interior of the cap 20, and where at least one nipple flange 14 is pushed out of the hole 23. When using a valve assembly 10', the nipple 15 is pushed or pulled through the hole 23 until the column top side 13 depicted in FIG. 1, is pressed against the interior of the cap 20, and where the nipple flange 14 is pushed out of the hole 23. If there is more than one nipple flange 14, they are all pushed out of the hole 23.

When an attempt is made to pull the nipple 15 backwards out of the hole 23, the nipple flange 14, having a diameter greater than that of the hole 23, prevents the nipple 15 and nipple flange 14 from being easily pulled out. The elasticity of the column 12 and nipple flanges 14 causes them to squeeze the cap top side 21 between them, so that the nipple flanges 14 press against the cap top side 21, and the column top side 13 and peripheral flange top side 13, in the case of valve assembly 12, press against the interior side of the cap 20.

Referring again to FIG. 4, the nipple 15 is preferably cut off, so that the length of the nipple 15 does not extend outward from the cap 20. Where there are two or more nipple flanges 14, a cross sectional cut is made to the nipple 14, between two of the nipple flanges 14. At least one nipple flange 14 must remain attached to the nipple 15. To prevent the nipple 15 from moving back through the hole 23.

Referring to FIG. 7, the valve assembly 10' is shown, in which the nipple 15' has been positioned in the cap 20, so that all nipple flanges 14' are on the outer side of the cap 20. A cap liner 32 is positioned between the single column holder and the cap 20, with the single column holder 12' and flange 14' providing a squeezing pressure against the cap 20 and cap liner 32, so that an airtight seal is created at the point where the top side 30 of the single column holder 12' contacts the cap liner 32, and where the nipple flange 14' contacts the outer side of the cap 20. The bottle lip 52, as shown in FIG. 4, will also press against any present cap liner 32, when the cap 20 is tightened onto the bottle, creating an airtight seal between the cap 20 and the lip 52 of bottle 50.

The cap liner 32 may be omitted, where a valve assembly 10, as shown in FIG. 1, is inserted into the cap 20. In this instance, the peripheral flange 72 of valve assembly 10, will occupy the area, and serve the same purpose, as the cap liner 32, as it is used with valve assembly 10'.

The holder column 12 is shown as completely surrounding the soft elastic core 18, with the passageway 70 being defined by the central portion of the soft elastic core 18, and the length of the nipple 15'.

Referring again to FIG. 4, cap 20 which houses the valve assembly 10, or valve assembly 10', is placed onto the mouth of a receiving bottle 50, so that the bottle's reciprocal screw type ridges 51, as shown in FIG. 4 are able to engage the first set of raised notches 25. As the cap 20 is tightened onto the bottle 50, additional rows of raised ridges 26 may also engage the bottle's reciprocal screw type ridges 51.

Where valve assembly 10 is used with the cap 20, the cap 20 may be tightened until the bottle lip 52 engages and presses against the valve assembly flange bottom side 17, which causes the valve assembly flange top side 13 to press even more firmly against the cap 20, so that an extremely strong airtight seal is created between the flange top side 13 and interior of cap 20.

Referring also to FIG. 5, a bottle 50 having a cap 20 with a valve assembly nipple 15 is shown, exampling the invention that is ready to receive pressure. Air pressure, or any gaseous pressure, is provided by an air needle 40, as shown in FIG. 4, with the air needle 40 having a hollow portion that allows air to be delivered by expelling it through a terminal port 45. The length and circumference of the air needle 40 allow it to be inserted through the valve assembly opening 16, or where the nipple 15 has been cut, through 16'. The terminal port 45 is pushed out of the bottom opening 18 and into the interior of the bottle 50. Higher pressure gas is then delivered through the air needle 40 and allowed to exit the terminal port 45 into the bottle 50, until a desired pressure level is reached inside the bottle 50. When the air needle 40 is withdrawn, the passageway 70, as defined within the soft elastic core 18, having open ends 16 or 16', collapses and restricts the release of any air from the bottle 50. Typically, two liter bottles, having a modified cap 20 and valve assembly 10 or 10' as described above, can be pressurized to 15 pounds per square inch, and provide the pressure necessary to achieve the desired qualities of the improved floatation bottle. Bottle 50 having pressure of this level will exhibit rigid sides, and be difficult to squeeze inward so as to cause the walls of the bottle 50 to collapse. This pressure allows the bottle 50 to be easily handled in water, and provide excellent floatation qualities. The pressure within the bottle maximizes the allowable volume of the bottle 50, which in turn maximizes the floatation quality of the bottle 50 when put in water. A bottle 50 having no increased pressure will lose some of its floatation quality when it is subjected to the force applied against it by water, which causes the walls of the bottle 50 to collapse inward slightly when for example it is pulled under water by a fish hooked on an attached line 53.

Referring again to FIG. 5, a loop of fishing line 52 encircles the neck of the bottle 50 adjacent to the cap 20, where the circumference of the loop of fishing line 52 is less than the circumference of the cap 20, so that the loop of fishing line 52 is securely held by the bottle 50 and cap 20. A descending length of fishing line 53, is attached to the loop of fishing line 52 on one end, with a hook 54 attached to its terminating end. Another length of fishing line 51 may be attached to the loop of fishing line 52 on one end, with a closed loop 59, intended to be used as an attachment point, or for attaching anchoring weights (not shown). A rubber band 58 or other similar elastic strap may also encircle the bottle 50, which allows the lines 51 and 53 to be attached to the sides of bottle 50, by tucking a portion of the line 51 and the terminating end of line 53 which has a hook 54 attached thereto, with the hook 54 itself able to be placed under the rubber band 58, or where the hook 54 is hooked to the rubber band 58 itself. This allows the bottle 50 to be stored with other similar bottles, so that the lines 51 and 53 from bottle 50, or from any other bottle do not get tangled together. The maintaining of pressure within bottle 50 allows lines 51 and 53 to be wound tightly around the bottle 50, and since the bottle does not collapse inward due to the force applied by lines 51 and 53, they do not slide along the length of the bottle 50, or have any loose portions that might become entangled with other lines from other bottles, while being stored in a random or unorganized manner.

From the foregoing statements, summary and description in accordance with the present invention, it is understood that the same are not limited thereto, but are susceptible to various changes and modifications as known to those skilled in the art and we therefore do not wish to be limited to the details shown and described herein, but intend to cover all such changes and modifications which would be encompassed by the scope of the appended claims.

I claim:

1. A cap valve comprising:

a. A valve assembly, having a holder column and a protruding nipple, with the nipple having at least one flange, with the top of the nipple having an opening that defines the top end of a passageway that extends through the nipple and holder column, where said passageway is oriented in a fairly straight line between the top opening and a bottom opening on the bottom side of the holder column;

b. A soft elastic core, situated within the holder column, where the soft elastic core is compressed by the holder column when situated within it, where the passageway it defines is collapsed so that air is unable to flow through said passageway; and c. A cap, capable of being screwed into a bottle, to provide an airtight seal, having a cylindrical side wall and a top side, where the top side defines a hole of sufficient size so that the nipple and at least one of the flanges on the nipple can be inserted through said hole, where the nipple flanges have a circumference greater than the hole, and where the nipple and the nipple flange is positioned in said hole so that the top end of the passageway is exposed and able to receive an air needle, with the nipple flanges preventing removal of the nipple out of the hole.

2. A cap valve as described in claim 1, where the holder column has a peripheral flange extending outward from the top side of the holder column, and which can fit against the underside of a cap.

3. A cap valve as described in claim 1, where the cap can be tightened onto a bottle.

4. An improved flotation bottle comprising:

a. A bottle, having a mouth that is capable of receiving a cap;

b. A valve assembly having a holder column and a nipple, with the nipple having at least one flange, with the top of the nipple having an opening that defines the top end of a passageway that extends through the nipple and holder column, where said passageway is oriented in a fairly straight line between the top opening and a bottom opening on the bottom side of the holder column;

c. A cap, capable of being screwed onto the bottle, to provide an airtight seal, having a cylindrical side wall and a top side, where the top side defines a hole of sufficient size so that the nipple and at least one flange on the nipple can be inserted through said hole, where the nipple flanges have a circumference greater than the hole, and where the nipple and the nipple flange are positioned in said hole so that the top end of the passageway is exposed and able to receive an air needle.

d. A soft elastic core, situated within the holder column, where the soft elastic core is compressed by the holder column when situated within it.

5. An improved flotation bottle as described in claim 4, where the holder column has a peripheral flange extending outward from the top side of the elastic valve.

6. An improved flotation bottle as described in claim 4, where the cap having a rubber holder column is tightened onto a bottle.

7. An improved floatation bottle as described in claim 4, having one or more fishing lines that are secured to said bottle on one end, and having a hook on one of said line's terminating end.

* * * * *